US005426795A

United States Patent [19]

Harty

[11] Patent Number: 5,426,795

[45] Date of Patent: Jun. 27, 1995

[54] DEVICE FOR DECONTAMINATING PERSONS CONTAMINATED WITH HAZARDOUS MATERIALS AND ALSO FOR MINIMIZING CONTAMINATION OF CLEANING PERSONNEL

[76] Inventor: Robert D. Harty, 11416 S. Homan, Chicago, Ill. 60655

[21] Appl. No.: 223,102

[22] Filed: Apr. 5, 1994

[51] Int. Cl.[6] ..... A47K 3/02

[52] U.S. Cl. ..... 4/584

[58] Field of Search ..... 4/546, 571.1, 573.1, 4/583, 584, 589, 536, 538, 553, 554

[56] References Cited

U.S. PATENT DOCUMENTS

| | | | |
|---|---|---|---|
| 3,822,421 | 7/1974 | Loren | 4/546 X |
| 4,034,424 | 7/1977 | Budlong | 4/580 X |
| 4,152,792 | 5/1979 | Glintz | 4/546 X |
| 4,305,165 | 12/1981 | Wall | 4/538 X |
| 4,371,995 | 2/1983 | Donhauser | 4/553 |
| 5,195,192 | 3/1993 | Garde | 4/573.1 X |

*Primary Examiner*—Charles E. Phillips
*Attorney, Agent, or Firm*—Cherskov & Flaynik

[57] ABSTRACT

The invention is a contamination control device which facilitates the decontamination of a person contaminated with hazardous materials, such as radiation, toxic chemicals, pathogens, etc., comprising a recessed patient bearing surface having a first end and a second end, a catch basin integrally attached to the second end of the patient bearing surface so as to isolate and store contaminated cleaning fluid and bodily fluid, including hazardous material, and an enclosed conduit that directs said contaminated fluid and bodily fluid from the patient bearing surface to the catch basin.

8 Claims, 3 Drawing Sheets

DEVICE FOR DECONTAMINATING PERSONS CONTAMINATED WITH HAZARDOUS MATERIALS AND ALSO FOR MINIMIZING CONTAMINATION OF CLEANING PERSONNEL

BACKGROUND OF THE INVENTION

1. Field of the Invention

The present invention relates to a device for handling contaminated persons and, more specifically, the invention relates to a device for handling individuals contaminated with radiation, toxic materials, pathogens, etc., in emergency room, medical triage, morgue or mortuary-type settings, while minimizing contamination of cleaning personnel.

2. Background of the Invention

The use of vigorous and sometimes messy resuscitation and emergency medical techniques is the bane of the existence of every emergency medical services (EMS) worker. Each year, hundreds of EMS workers are inadvertently exposed to detrimental materials during efforts to decontaminate patients. Pathologists, morgue-technicians and mortuary personnel face similar hazards.

With the constant threat of exposure to bodily-fluid borne pathogens, caustic toxics, and radiation contamination, EMS personnel must minimize their own exposure while also decontaminating their patients as quickly and efficiently as possible. Examples of hazardous substances that EMS personnel must concern themselves with include, but are not limited to, Human Immune Virus (HIV), Hepatitis, harsh inorganic acids and bases of varying molarities, harsh organic acids and bases of varying molarities, and radioactive materials, said materials ranging in activity from approximately 100 counts per minute (cpm) to 500 Roentgens (R). In many instances federal and state laws mandate that affirmative steps be taken to protect decontamination workers. For example, Occupational Safety and Health Administration rules (29 CFR 1910.1030) specify when and how EMS workers are to be protected from blood born pathogens. Additional legislation promises to further scrutinize worker safety and contaminated-fluid disposal in both the medical triage and mortuary industries. Indeed, many of the concerns of EMS workers also effect morgue and mortuary personnel, particularly during autopsy and embalming processes.

Various devices exist for handling patients, either at the scene of exposure or in the emergency room. One type of device is an enclosed shower arrangement wherein the patient uses water flow, body brushes, wash cloths, and the like to decontaminate himself. In these instances, all cleaning materials, including the waste water, must be retained for proper disposal. Enclosed shower arrangements are bulky and expensive, and require a somewhat lucid patient to do his or her own cleaning. Such systems also cannot be transported easily while in use.

Another decontamination method involves placing the exposed patient, who is often only semiconscious, onto a decontamination table whereby EMS personnel would scrub the patient. An example of this type of decontamination device is U.S. Pat. No. 4,819,925.

Another decontamination device, called Toxitub®, manufactured by GlassMed Inc., of Kensington, N.H., features a tub configuration nested into a metal tub retention frame.

There are several drawbacks with current decontamination table devices. One such drawback is that with some devices, cleansing fluids, such as water or detergent, and body fluids splash off the patient and table surface and onto adjacent structures and EMS personnel. This is due to the fact that the patient is not recessed into the unit. Furthermore, devices in which persons are laying flush with the top of the unit present a roll-off hazard to patients.

Another salient drawback to current decontamination devices on the market is that accompanying catch basins are stand alone units. Stand alone basins are easily tipped over during the bustle of patient care, resulting in contaminated fluid spilling onto emergency room or medical triage room floors and surfaces. The existence of stand alone catch basins also require that both the basin and the patient-bearing surface be moved in tandem, lest the conduit connecting the two units detach, resulting in spillage and subsequent contamination of surrounding surfaces. Such in-tandem transport usually requires that at least two workers help in moving the device when in use. This multi-personnel requirement hampers the rapid, contamination-free removal of a contaminated individual from an accident scene in instances where conditions suddenly worsen; as such, the safety of both EMS worker and patient can be jeopardized.

Another problem with typical table configurations is that EMS personnel, who by necessity often have to do most of the patient's cleaning, must wear special disposable, scrub-suit-like garments to minimize exposure to contaminating substances.

Yet another problem with some decontamination devices is that metal or other electrically conductive material incorporated into the devices are not insulated. In these instances, EMS personnel must use extreme caution before attempting to cardiovert or defibrillate cardiac cases so as to avoid electrocution.

Generally, the prior art is lacking in that many of the devices currently in use address only the decontamination aspect of patient care and not the EMS worker safety aspect of patient care.

A need exists in the art for providing a contamination control device to allow EMS personnel to thoroughly decontaminate exposed patients while also affording those EMS workers maximum protection from exposure either on the scene of exposure, en route to medical facilities, or in the medical facility itself. The device should be applicable to decontaminate patients who are not only fully conscious, but also for those patients who are semi-conscious, unconscious, or who must be restrained or rendered immobile. Such a device is also necessary to protect pathology, morgue and mortuary personnel from exposure to deleterious pathogens, chemicals or radiation. Finally, the device should allow rapid and contamination-free evacuation of a contaminated individual from a splash scene while the device is in use by requiring a minimum number of evacuation personnel.

SUMMARY OF THE INVENTION

It is an object of the present invention to provide a device for minimizing contamination of EMS workers and for decontaminating patients in an EMS environment which overcomes many of the disadvantages of the prior art.

It is another object of the present invention to provide a device for decontaminating a person contaminated with radiation, toxic chemicals and pathogens. A feature of the invention is the utilization of a recessed patient bearing surface. An advantage of the invention is that the device isolates cleaning personnel from cleaning fluid which has contacted the contaminated person, thereby allowing for vigorous use of cleaning methods and fluids in decontaminating the effected person.

Yet another object of the present invention is to provide a device for cleansing the exterior of persons contaminated with radiation, toxic materials, pathogens, etc., which also allows for speedy one-step relocation of the device by a single decontamination worker during use. A feature of the invention is the attachment of a catch-basin to a recessed patient-bearing surface. An advantage of the invention is the immediate isolation of contaminated waste- and bodily-fluid so as to afford easy collection and disposal of the fluid, greater worker protection, and one-piece transportability of the device.

Another object of the present invention is to provide a device to protect decontamination personnel from harmful substances during the course of cleaning a supine person. A feature of the invention is a patient bearing surface outfitted with a splash canopy and an integrally connected catch-basin. An advantage of the invention is that high volume water can be utilized to quickly decontaminate the patient, while affording maximum protection to EMS personnel.

Briefly, the invention provides for a device for decontaminating a person exposed to hazardous materials, such as radiation, toxic chemicals, pathogens, etc., comprising a liquid impermeable container having a first end and a second end, said container adapted to receive a recessed patient bearing surface, a catch basin removably attached to the second end of the patient bearing surface so as to isolate and store contaminated cleaning fluid and bodily fluid, and an enclosed conduit that directs said contaminated fluid and bodily fluid from the liquid impermeable container to the catch basin.

BRIEF DESCRIPTION OF THE DRAWING

These and other objects and advantages of the present invention will become readily apparent upon consideration of the following detailed description and attached drawing, wherein.

DETAILED DESCRIPTION OF THE INVENTION

Figure 1:
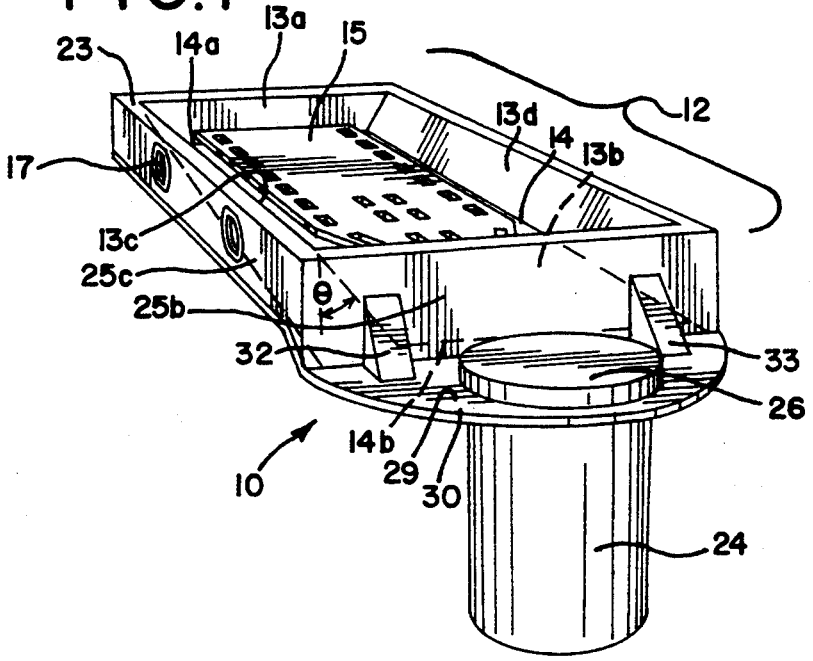
FIG. 1 is a front elevational view of a new and improved decontamination table in accordance with the features of the present invention.
Figure 2:
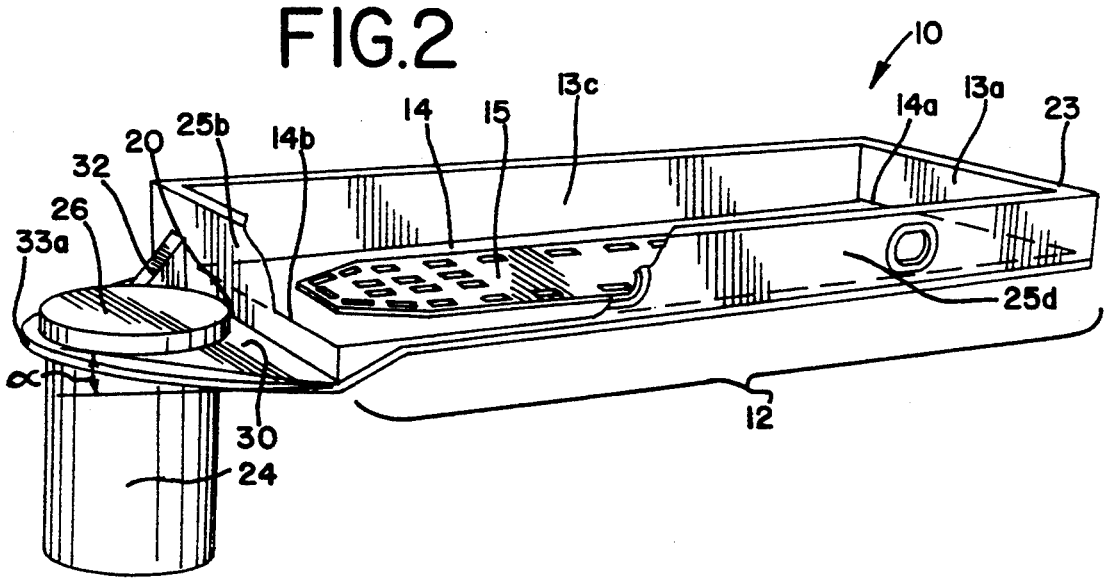
FIG. 2 is an elevated cut-away view of the decontamination table in accordance with the features of the present invention.

The decontamination of persons exposed to pathogens, toxic chemicals, and radiation poses risks for EMS, morgue and mortuary personnel. The present invention, designated generally as 10 in FIGS. 1–2, provides these workers with optimum splash protection while also affording easy and efficient access to a contaminated patient.

The device 10 is constructed to be easily lifted by one person. It is designed to be positioned on a standard hospital gurney, hospital bed, ambulance stretcher, autopsy table, or medical examination table, while in use. The device 10 is also designed to be hung on a wall for storage.

The device 10 comprises a basin-like, water impervious container 12 with four raised sloped peripheral sides 13*a–d* so as to afford at least partial separation of patient and care-giver. The water impervious container 12 can be fabricated in a myriad of different widths and lengths, depending on the size of the individual to be decontaminated, and whether the unit will be dedicated for one patient type, such as that found in a children's hospital or medical facility. However, in instances whereby the device will serve a myriad of contaminated person sizes, generally a width of the water impervious container of between approximately 30 inches and 36 inches and a length of between approximately 75 inches and 90 inches will suffice. In one embodiment of the device, the width of the water impervious container 12 is approximately 32.5 inches and the length of the water impervious container is approximately 86 inches. The overall length of the device 10 is approximately 103 inches, including an integrally connected catch basin support 30.

Figure 3:
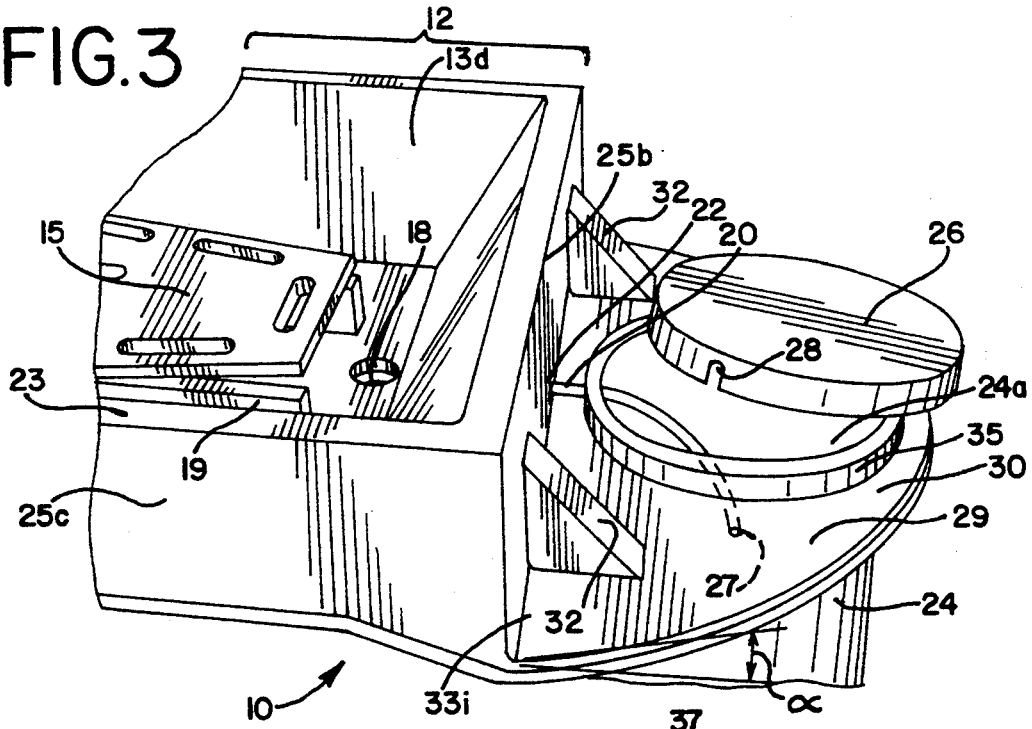
FIG. 3 is a detailed view of the catch-basin area of the decontamination device in accordance with the features of the present invention.
Figure 4:
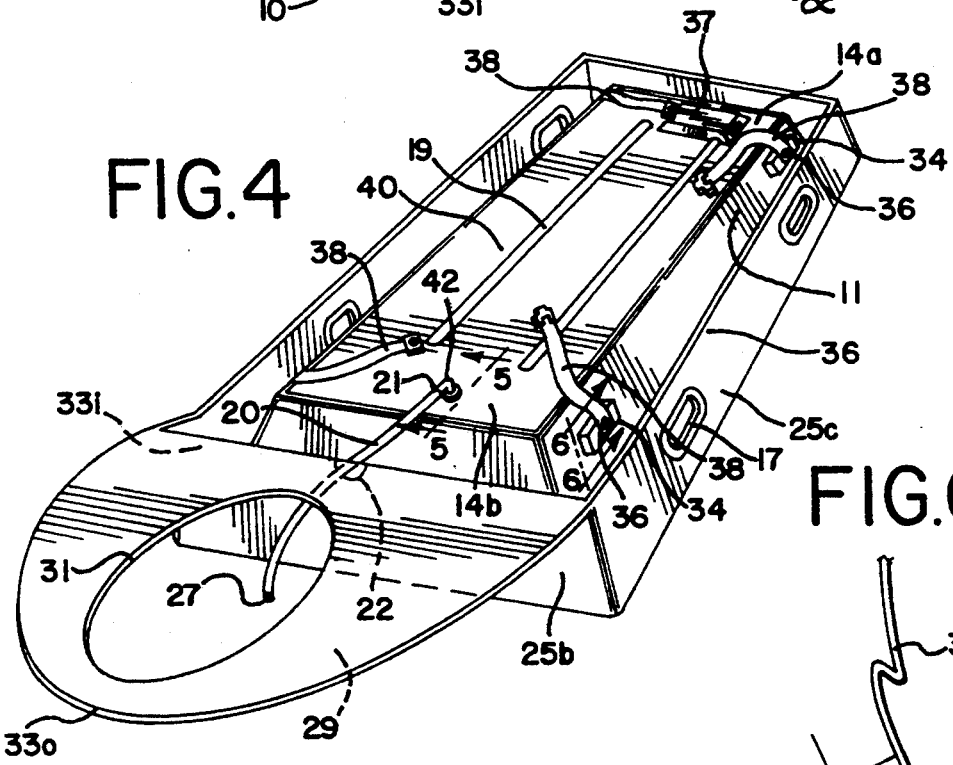
FIG. 4 is a bottom elevational view of the decontamination table, in accordance with the features of the present invention.

Generally, the basin-like, water impervious container 12 has a sloped interior floor surface 14 so as to facilitate drainage of cleaning- and bodily-fluids through a floor aperture 18 as seen in FIG. 3. The floor 14 has a first end 14*a*, near where a supine patient's head may be positioned, and a second end 14*b*, near where the patient's feet may be positioned. The floor aperture 18 is located along the longitudinal axis of the floor and medial to the second end 14*b* of the interior floor surface 14. To facilitate drainage even more efficiently, an incline support 37, as shown in FIG. 4, can be positioned at the first end 14*a* of the underside surface 40 of the sloping interior floor 14 so as to raise the first end 14*a* of the sloped interior surface 14 relative to the second end 14*b* of the sloped interior floor surface 14 when the device is positioned on a level surface such as a gurney.

The device also consists of a patient-bearing surface 15 which may be a backboard, stokes basket, or any other patient carrier. Any patient bearing surface 15, such as the backboard pictured in FIGS 1–3, must be adapted to be received by the water impervious container 12, so as to be nested inside the water-impervious container 12. The patient bearing surface 15, must itself be water impervious, and impervious to polar and semi-polar substances, generally. To facilitate handling of patients who are initially placed on backboards prior to placement into the device, a plurality of raised support ribs 19 longitudinal to and integrally connected to the sloped interior floor surface are provided to support the underside surface of the backboard 15.

The sloped interior floor surface 14, alternatively may serve as a patient-bearing surface, thereby resulting in the water impervious container 12 itself serving as a stokes basket, or a backboard.

Peripheral Side Detail

The raised sloped peripheral sides 13*a–d* are at least high enough to prevent fluid from splashing off of a contaminated person lying in the unit 10 and onto surfaces and personnel situated along side the unit. As such, the raised peripheral sides 13*a–d* are fabricated to be approximately five to ten inches in height from the sloped interior floor surface 14 to a top edge 23 of the device 10, depending on person sizes that are anticipated being handled. The sides are high enough to prevent accidental rolling off of persons placed into the device 10, and also to prevent splashing of cleaning fluids to adjacent surfaces outside of the device 10.

The raised sloped peripheral sides 13*a–d* are pitched proximally medially from the top edge 23 of the device 10 to converge toward the longitudinal axis of the sloped interior floor 14 so as to facilitate fluid flow from the sides 13*a–d* to the sloped interior floor 14. The pitch can vary from between approximately 25 degrees and 35 degrees, and preferably 30 degrees, and is designated as $\theta$ in FIG. 1. The raised peripheral sides 13*a–d* terminate at the top edge 23 of the device 10. The top edge 23 extends laterally, thereby defining a top edge surface, and then depends downward 90 degrees relative to the plane defined by the top edge surface to form a skirt consisting of outer walls 25*a–d* surrounding the outer surface 11 of the raised sloped peripheral sides 13*a–d*, respectively.

Splash Barrier Detail

Figure 7:
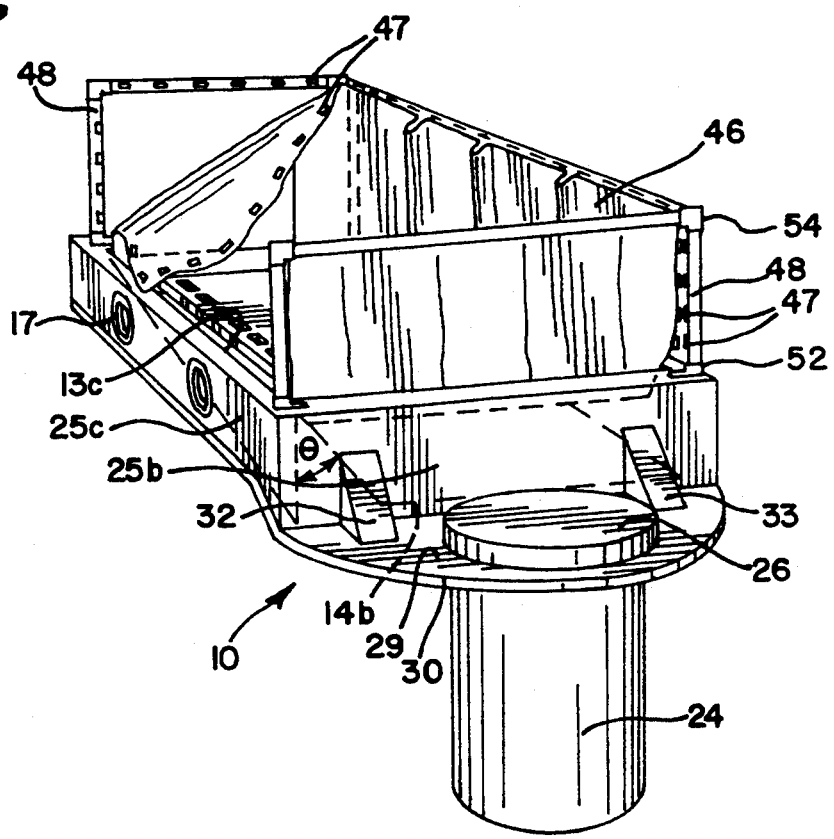
FIG. 7 is a front elevational view of the decontamination table with splash protector attached in accordance with the features of the present invention.
Figure 8:
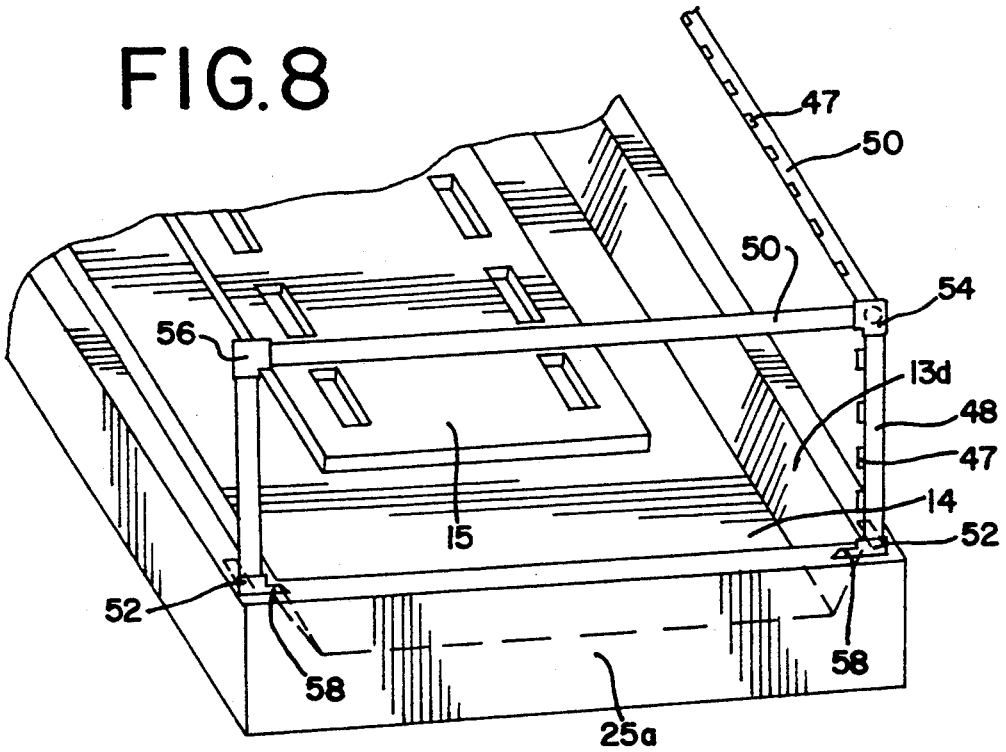
FIG. 8 is a detailed view of the support structure of the splash protector depicted in FIG. 7, in accordance with the features of the present invention.

The height of the raised peripheral sides 13*a–d* can be either fixed at the time of fabrication of the device 10, or extendable so as to afford additional splash protection to cleaning personnel in those instances where the use of high volume and velocity water streams are warranted. As depicted in FIGS. 7 and 8, these raised peripheral side extensions consist of liquid impermeable sheets 46 removably attached to vertical support members 48 and horizontal support members 50 so as to form a liquid impermeable barrier or curtain around one of the two longitudinal raised sloped peripheral sides 13*c*, 13*d* of the unit 10 and the two opposing short raised sloped peripheral sides 13*a*, 13*b* of the unit. The liquid impermeable sheets 46 are removably attached via any suitable fastening means 47 such as Velcro ®-type fasteners, male-female snap-fit assemblies, or string to the horizontal support members 50, and vertical support members 48, said sheets depending down into the patient containment area of the unit 10 and below the top edge 23 of the unit so as to minimize splashing of fluid from the patient compartment of the device 10.

The liquid impermeable sheets 46 also can be constructed so as to slidably receive the horizontal support members 50, prior to attachment of said members to their respective vertical support members 48. An exemplary sheet configuration to affect this type of attachment includes a sleeve running longitudinally along one edge of the sheet so as to slidably receive a horizontal support member 50. In this type of barrier construction, one sheet is utilized for each side of the containment device 10 where splash protection is desired. Abutting edges of two sheets are then sealed together using Velcro ®-type fasteners, male-female snap-fit assemblies, stitching, nonmetallic zipper or Zip-Loc ®-type assemblies, or other means of closure.

As depicted in FIG. 7 the vertical support members 48 are attached to the top edge of the device 10 via support members 52, themselves attached to top edge 23 of the unit 10 by adhesive, snap assemblies, screws, bolts, welds, extrusion molding, or other coupling means. Above the right angle intersection of the draped raised sloped peripheral side 13*d* with the adjacent draped raised sloped peripheral sides 13*a*,13*b*, two horizontal support members 50 converge on a single vertical support member 48 via a three-way coupling means 54, to effect a 90-degree angle. Above the right angle intersection of the then opposite (nondraped) longitudinal raised sloped peripheral side 13*c* the short sides of the unit, 13*a*, 13*b*, a single horizontal support member attaches to a single vertical support member 48 via a support elbow 56.

As an alternative to employing a liquid-impermeable curtain for splash protection, a liquid-impermeable splash hood or canopy (not shown) is attached to the top edge 23 of the raised peripheral sides, said canopy similar in configuration to those collapsible canopies found on infant strollers, or rigid, removable canopies of similar design. Either the raised peripheral sides extenders or the canopy is removably attached to the top edge 23 of the raised peripheral sides so as to facilitate runoff of fluid from the fluid-contacted surface of the extender sheets or canopy and into the water impervious container 12. Attachment of the extender sheets or canopy to the edge 23 is effected by Velcro ®-type fasteners, nonmetallic snap assemblies, or nonmetallic zipper assemblies.

Waste Routing and Storage Detail

Figure 5:
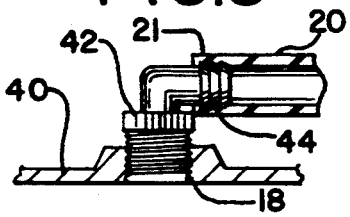
FIG. 5 is a view taken along line 5—5 of FIG. 4.

As depicted in FIGS. 4 and 5, situated adjacent to and medially of the second end 14*b* of the sloped interior floor surface 14 and along the longitudinal axis of the floor is a threaded aperture 18. This aperture 18 serves as a drain opening adapted to receive fluid resulting from decontamination procedures. One end of this aperture 18 is adapted to receive a waste water conduit 20. The conduit 20, which can be comprised of glass, plastic, nylon, PVC, and polyethylene is of a length sufficient to direct waste water received from the aperture 18 to a catch basin 24. The conduit 20 connects the aperture 18 to a receiving end 24*a* of the catch basin 24 via a conduit channel 22, said channel being an annular opening through the base of the exterior side 25*b* at the median point of said side and distal to where the raised sloped interior side 13*b* intersects with the second end 14*b* of the sloping interior floor surface 14.

As depicted in FIGS. 4 and 5, the drain assembly of the device 10 comprises nylon, plastic, PVC, polyethylene or fiberglass units. Plastic or nylon elbow fittings 42 or flexible fittings are used to connect a first end 21 of the drain conduit 20 to the underside of the device. While this connection is effected via a stretch fit of the first end 21 of the conduit 20 over a flared portion 44 of the elbow fitting 42, a nonmetallic hose clamp or a male female threaded configuration also can be used to effect a leak-proof connection. The elbow fitting 42 is connected to the underside of the device 10 in a male-female threaded arrangement wherein the elbow fitting 42 is the male threaded element and the floor aperture 18 is also threaded to receive said fitting 42. Elbow fittings of the type utilized in the drain detail, disclosed supra, are also commercially available from United States Plastics, Lima, Ohio.

Catch Basin and Support Structure Detail

The catch basin 24, depicted as being generally cylindrical in shape, is nested into the catch basin support structure 30, said structure integrally connected to the water impervious container 12 at the base of the raised peripheral side 25*b*. The catch basin 24 can be any shape, including, but not limited, to cylindrical, conic, rectangular, and cubic. The corresponding catch basin support structure 30, would then be adapted to slidably receive the corresponding shape of the catch basin 24. The catch basin support structure 30 is generally an elliptically shaped planar structure terminated on one side by an inner edge 33*i* that is integrally connected to the base of the raised peripheral side 25*b*. The catch-basin support structure is pitched downwardly from its outside elliptical edge 33° to its inside straight edge 33*i* approximately five degrees, designated as $\alpha$ in FIGS. 2 and 3 so as to confer additional strength to the protruding catch basin support structure 30. In addition to the integral connection of the catch basin support structure 30 to the base of the raised peripheral side 25*b*, additional support of the support structure 30 is provided via support members 32 extending from and integrally connected to the peripheral side 25*b* and integrally connected to a first surface 29 of the support structure 30.

The support structure 30 is adapted to slidably receive the catch basin 24 through a generally circular support structure opening 31, said support structure opening having a diameter equal to the outer diameter of the catch basin 24, but less than the outer diameter of a catch basin lip or flange 35. The catch basin lip 35, integrally attached to the outer periphery of an open end 24*a* of the basin, serves to prevent the catch basin from sliding completely through the support structure opening, thereby anchoring the catch basin to the support structure 30. The catch basin lip 35 has an outer diameter corresponding with the inner diameter of a catch basin lid 26, with both the lip and lid containing a drain conduit notch 28. When aligned with the drain conduit channel 22, said notch 28 is adapted to receive the drain conduit 20 without imparting any deformation or occlusion of the drain conduit 20, thereby allowing a second end 27 of the drain conduit 20 to freely hang and depend downward into the catch basin 24.

The length and capacity of the catch basin 24 will vary, depending on where the decontamination operations are performed. For example, decontamination done in an emergency room will allow for use of 10–15 gallon basins, for maximum liquid storage capacity. Decontamination procedures done en route to medical facilities may require the use of half-height containers, with maximum capacities of 4–6 gallons, so that the device can be used on an ambulance stretcher without interference with the ambulance or transport vehicle floor. A myriad of catch basin designs and capacities can be utilized in the device, and are available commercially from container suppliers such as the standard weight calibrated polyethylene storage tanks with external flange manufactured by United States Plastics, of Lima, Ohio.

Construction Material Detail

Much of the device 10 is constructed with nonmetallic material. For example, the water-impervious container 12, side extenders and canopy are constructed with materials that will allow for easy cleaning and which will not be prone to corrosion. Also, the construction materials are radiotranslucent for those instances where patients must be immobilized at the scene either for splinting purposes or for subsequent x-ray analysis.

Typical materials for construction include, but are not limited to, plastic, glass, fiberglass, ceramic, sealed wood, treated cardboard, polyvinyl chloride, glass, thermoplastic, reinforced thermoplastic (such as polypropylene, polycarbonate, polybutylene, terephalate, and polyphenylene sulfide) and sheet molding compounds (such as polyester), or a combination of these materials.

With regard to the construction of the three-walled splash barrier, the various support members, the liquid impermeable sheet, couplers and elbows all consist of noncorrosive, nonmetallic-type materials so as to minimize corrosion. As such, the various support members, couplers and anchors can be constructed with PVC piping, nonmetallic rod stock, nonmetallic struts, trusses, brackets, flanges, braces, or other type of shaft comprised of plastic, wood, fiberglass and the other noncorrosive materials enumerated supra. Said members can be conjoined via male-female threaded arrangements, adhesive, screws, bolts, welds or other type of permanent or temporary coupling means that are nonmetallic in nature.

The liquid impermeable sheeting material 46 can be constructed from a myriad of flexible materials, such as blown film (ethylenevinyl acetate, polyethylene, polyvinyl chloride), cast film (polyethylene, polypropylene, nylon, polyester, and polyvinyl chloride), treated cloth or any other sheeting material. Examples of commercially available liquid impermeable material includes Herculite® from Herculite Products, Inc., York, Pa., Tyvek® from I. E. Dupont, Atlanta, Ga., and Saranex® from Dow-Corning of Midland, Mich.

Alternatively, materials to construct the liquid impermeable splash hood or canopy (not shown) are constructed from fiberglass, cardboard, wood, plastic, polyvinyl chloride, treated cloth, glass, thermoplastic, reinforced thermoplastic, and sheet molding compounds. The splash hood, canopy or barrier sheet, while necessarily liquid impermeable, is not necessarily as durable as what is mandated for the device 10, since these added barriers are an optional adjunct to the device and manufactured for one-time use and disposal.

Figure 6:
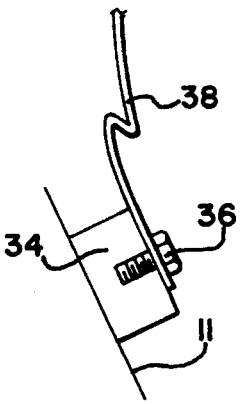
FIG. 6 is a view taken along line 6—6 of FIG. 4.

To provide additional care-giver protection, and as depicted in FIGS. 4 and 6, the construction materials of the water-impervious container 12 include electric-insulating material 34 surrounding metallic objects, such as metallic anchoring bolts 36. In this instance, the anchoring bolts are utilized to facilitate attachment of gurney straps 38 to an underside surface 40 of the device 10. The electrically insulating material 34, such as wood, plastic, and other nonelectrically conducting substrates, is incorporated to prevent arcing in those instances where cardioversion and defibrillation of a patient placed in the device 10 is necessary. The insulating material 34 is attached to the outer surface 11 of the raised sloped peripheral sides 13*c* and 13*d* via adhesive, fiberglass material or other nonconducting material.

The device 10, including the catch basin 24, and the optional splash barrier sheet 46 is relatively impermeable to a myriad of substances, including, but not limited to, water, various alcohols (including methanol, ethanol, propanol, isopropanol, butanol, etc.) ketones, aldehydes and other polar and nonpolar aliphatics, (substituted or otherwise, for example degreasers such as the halogenated ethylenes, carbon tetrachloride, chloroform), the most commonly transported polar and nonpolar aromatics (such as toluene, benzene, halogenated aromatics, xylene, substituted aromatics, etc.), polyaromatics (such as naphthalene and its halogenated counterparts), biphenyls (such as polyhalogenated dibenzo dioxins, pesticides, etc.), organic and inorganic acids and alkalies, various motor fuels, inorganic compounds (such as ammonia and the halogens fluorine, chlorine, bromine and iodine), among others. Obviously, permeability will not be absolute for all substances. However, the nature of the materials used to construct the device (reinforced thermoplastics, for example are extremely resilient to polar and nonpolar chemicals), and the operation of the invented device (wherein copious amounts of water and surfactants are employed in decontamination procedures to dilute the contagion) result in minimal direct and sustained contact of the above enumerated compounds to the device 10 at high molarities. Therefore, the structural integrity of the device 10 will not be compromised.

While the invention has been described with reference to details of the illustrated embodiment, these details are not intended to limit the scope of the invention as defined in the appended claims.

The embodiment of the invention in which an exclusive property or privilege is claimed is defined as follows:

1. A device for cleansing a person who has been exposed to hazardous material, comprising:

a) a container adapted to receive the person, said container having raised peripheral sides;

b) a means for removing fluid from the container without tipping the container;

c) a conduit providing for passage of the fluid from the container to a catch basin;

d) a catch basin support structure extended laterally to one raised peripheral side of the container; and e) a catch basin slidably received by the support structure so as to be positioned adjacent said one raised peripheral side of the container, said catch basin communicating with said conduit to receive and store the fluid.

2. The device as recited in claim 1 wherein the container, the means for isolating passage of fluid, the catch basin support structure, and the catch basin are comprised of nonmetallic material.

3. The device as recited in claim 1 further including means for enabling the device to be radiotranslucent.

4. The device as recited in claim 1 wherein the container is impervious to polar, semi-polar and nonpolar liquids.

5. The device as recited in claim 1 wherein the catch basin is impervious to polar, semi-polar and nonpolar fluids up to temperatures of at least approximately 160° F.

6. The device as recited in claim 1 wherein the device is configured to be positioned and removably attached to a standard hospital gurney.

7. The device as recited in claim 1 wherein the device is configured to be positioned and removably attached to an ambulance stretcher.

8. The device as recited in claim 1 wherein the means for removing fluid from the container without tipping the container is a sloped floor surface.

* * * * *